US005679047A

United States Patent [19]

Engel

[11] Patent Number: 5,679,047

[45] Date of Patent: Oct. 21, 1997

[54] VIBRATORY TOY AND GAME APPARATUS

[76] Inventor: Robert W. Engel, 548 N. Hollyburne La., Thousand Oaks, Calif. 91360

[21] Appl. No.: 548,577

[22] Filed: Oct. 26, 1995

[51] Int. Cl.[6] ..... A63H 11/02

[52] U.S. Cl. ..... 446/3; 463/65

[58] Field of Search ..... 446/5, 324, 325, 446/326, 351, 355, 437, 444; 273/237, 243, 246, 247; 463/65, 68, 58

[56] References Cited

U.S. PATENT DOCUMENTS

| | | | |
|---|---|---|---|
| 2,179,084 | 11/1939 | Cook | 463/65 |
| 2,813,371 | 11/1957 | Tiebe | 446/3 |
| 2,817,183 | 12/1957 | Digirolamo | 446/3 |
| 2,861,807 | 11/1958 | Dormoy | 463/65 |
| 2,919,921 | 1/1960 | Berger | 446/3 X |
| 2,973,604 | 3/1961 | Digirolamo et al. | 446/3 |
| 3,011,787 | 12/1961 | Modica et al. . | |
| 3,209,491 | 10/1965 | Roeper | 446/444 X |
| 3,588,107 | 6/1971 | Kupperman et al. . | |
| 3,769,743 | 11/1973 | Benkoe et al. . | |
| 3,841,636 | 10/1974 | Meyer . | |
| 3,940,140 | 2/1976 | Meyer et al. . | |
| 4,237,648 | 12/1980 | Moe et al. | 463/68 X |
| 5,162,009 | 11/1992 | Vaughn . | |

FOREIGN PATENT DOCUMENTS

| | | | |
|---|---|---|---|
| 174283 | 1/1917 | Canada | 446/325 |
| 1067129 | 6/1954 | France | 446/3 |
| 1182562 | 6/1959 | France | 446/444 |
| 440359 | 6/1949 | Italy | 446/326 |

*Primary Examiner*—D. Neal Muir
*Attorney, Agent, or Firm*—Charles B. Katz

[57] ABSTRACT

A vibratory toy and game apparatus is disclosed including structures for dynamically isolating the frame from the vibrating play surface. The apparatus comprises a vibration base having a vibratory motor attached thereto, a play base rigidly secured to the vibration base, a frame for supporting the apparatus on a surface, and elastic isolator members for mounting the vibration base to the frame, the isolator members preventing the transmission of vibrations from the vibration base to the frame. The apparatus further includes a plurality of play pieces which move on the upper surface of the play base in response to vibration thereof.

26 Claims, 6 Drawing Sheets

VIBRATORY TOY AND GAME APPARATUS

FIELD OF THE INVENTION

The present invention relates to a toy and game apparatus, and more particularly to a toy and game apparatus using vibratory means to cause play pieces to move over a surface.

BACKGROUND OF THE INVENTION

Toys and games frequently utilize multiple play pieces which move on the surface of the game or toy. While play pieces may be moved manually by the player or players, it is of great appeal to children to provide pieces which move on their own. A drawback of this approach is that the cost of adding motive power (such as electric motors) to multiple pieces significantly raises the total expense of the toy or game.

Vibratory games and toys, in which individual play pieces move on a playing surface in response to vibration thereof, have been known in the art for well over a century. Examples of games and toys employing vibrating surfaces to produce motion of play pieces are disclosed in U.S. Pat. No. 3,011,787 (Modica et al., entitled "Racing Game"); U.S. Pat. No. 3,769,743 (Benkoe et. al., entitled "Vibratory Toy"); U.S. Pat. No. 3,841,636 (Meyer, entitled "Vibratory Game"); U.S. Pat. No. 3,940,140 (Meyer et. al., entitled "Vibratory Board Game Apparatus), and; U.S. Pat. No. 5,162,009 (Vaughn, entitled "Toy Race Track Apparatus"). Typically, the vibratory game or toy apparatus includes a small electric motor having a weight mounted eccentrically on the motor's shaft, the motor being attached to the playing surface. Actuation of the motor produces a rapid eccentric periodic movement of the weight, which in turn causes the playing surface to vibrate. Alternatively, vibration may be effected by manual means, such as eccentrically mounting a weight on a shaft rotatable by the player.

One significant disadvantage associated with vibratory games and toys is their high noise level. Because of the rigid construction of most games and toys of this type, activation of the vibrational means causes the entire game or toy unit to vibrate, producing a loud and objectionable buzzing noise. Vibration of the toy or game's housing has the additional undesirable effect of causing "creeping", or movement of the game or toy unit on the surface (such as a table or floor) on which it rests.

SUMMARY OF THE INVENTION

It is therefore an object of the invention to provide an inexpensively manufactured toy and game apparatus having means for vibrating a surface and producing movement of play pieces placed thereon.

It is a more specific object of the invention to provide a vibratory toy and game apparatus including means for substantially reducing the noise produced thereby.

It is another object of the invention to provide a vibratory toy and game apparatus having a system of tracks or guides for controlling the directional movements of the play pieces.

It is yet another object of the invention to provide a vibratory toy and game apparatus having play pieces which exhibit both translational and rocking or wobbling movement.

It is a still further object of the invention to provide a vibratory toy and game apparatus in which the play pieces are capable of moving over a play surface including hills, slopes or other topological features.

The foregoing as well as other objects are achieved by the present invention in its preferred and alternative embodiments. The apparatus includes a generally horizontal play base on top of which a plurality of play pieces move in response to vibration of the base.

Vibratory means, preferably comprising an electric motor having a weight mounted eccentrically on the motor's shaft, are housed in a vibration base disposed beneath and rigidly secured to the play base.

The vibration base is mounted to the game or toy frame utilizing isolator means, preferably comprising a plurality of elastic members attached to the vibration base and frame and extending therebetween. The isolator means serve to dynamically isolate the frame from the play base/vibration base assembly, thereby preventing the transmission of vibrations to the frame and minimizing the associated problems of excessive noise and movement of the game or toy unit on the surface on which it is supported.

The play pieces are adapted with a plurality of flexible driver members which extend downwardly and rearwardly from the bottom of the play piece's base and engage the surface of the play base. The rearward cant of the driver members causes a preferential forward motion of the play piece. A system of guides or tracks may be provided on the play base surface to control the directional movements of the pieces. The guide may comprise a single rail which engages a corresponding slot formed in the lower portion of the play piece base. Alternatively, a track may be formed on the play base surface comprising two parallel rails having an orthogonal spacing slightly greater than the width of the play piece base. To effect a rocking or wobbling motion of the play piece on its base, the body of the play piece may be pivotally mounted on a generally vertical post extending upwardly from the play piece base.

DETAILED DESCRIPTION OF THE INVENTION

Figure 1:
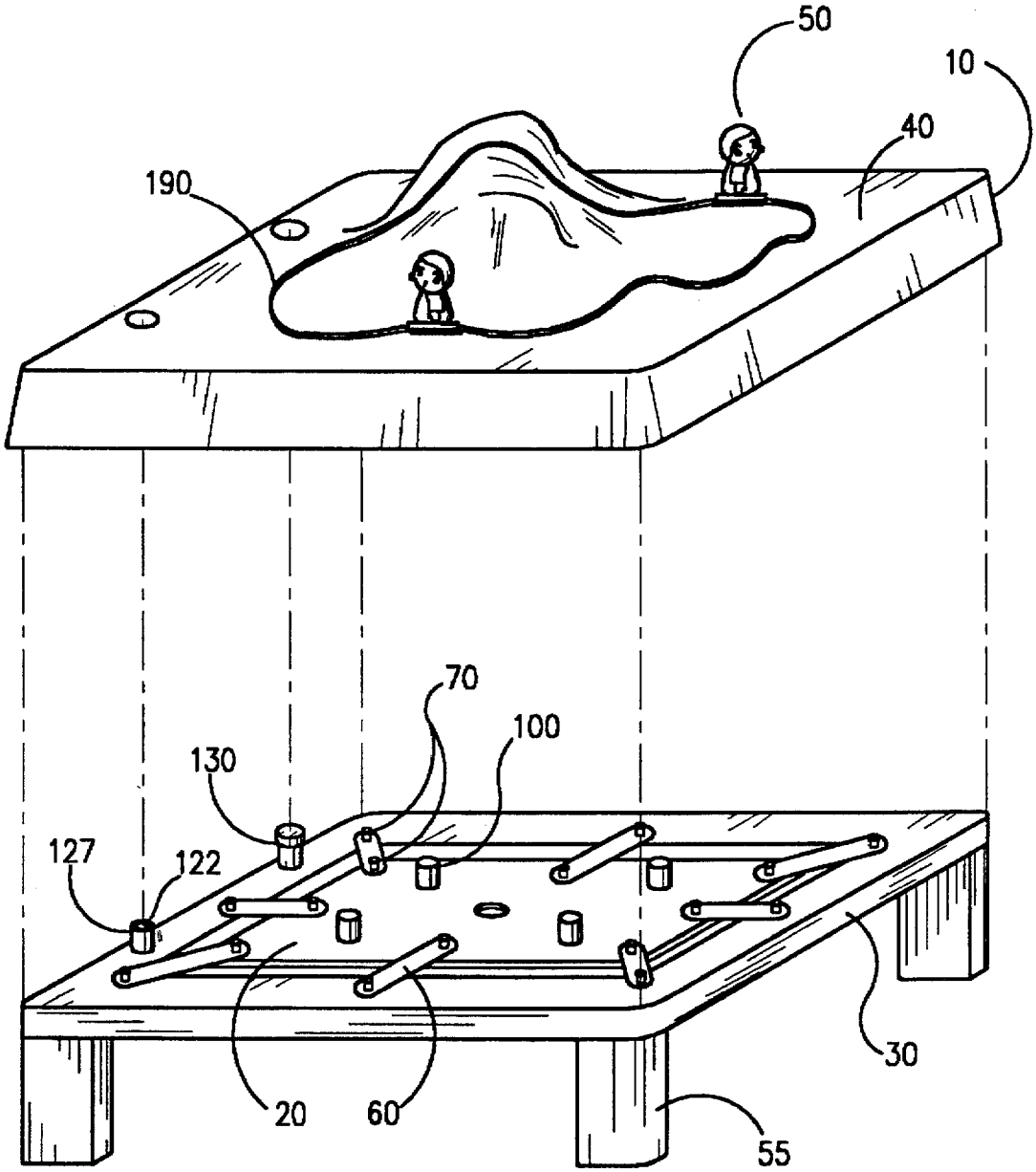
FIG. 1 is an exploded perspective view of the first embodiment of the invention with the play base removed from the frame/vibration base assembly.
Figure 2:
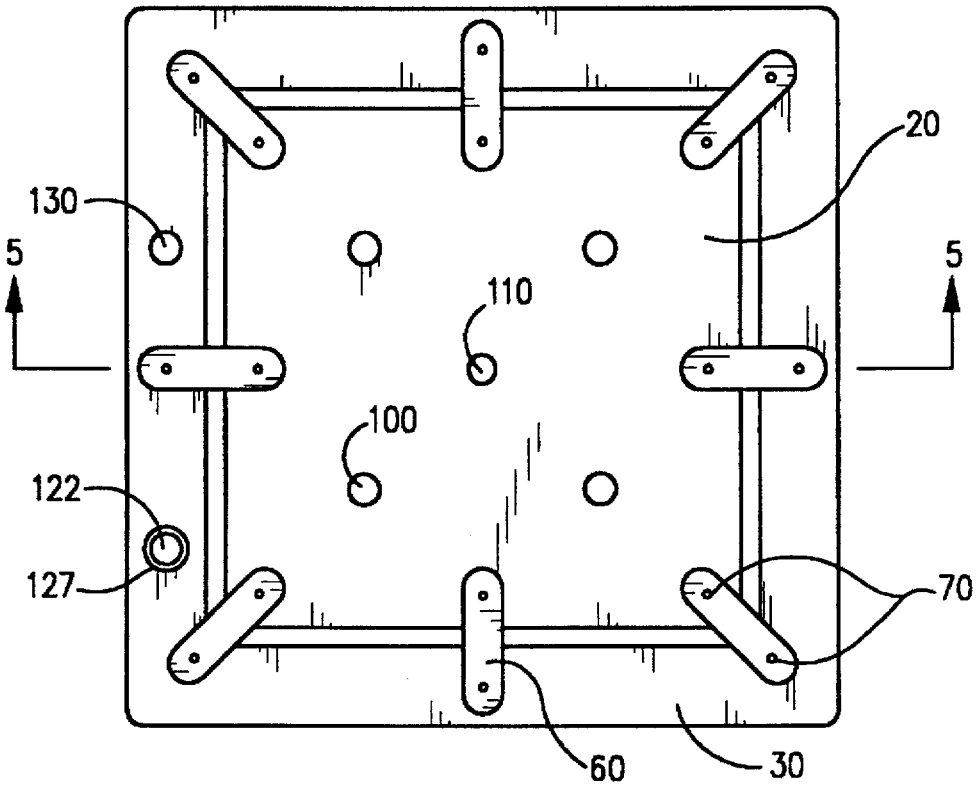
FIG. 2 is a top plan view of the frame/vibration base assembly with the play base removed.

Initial reference being made to FIGS. 1 and 2, it is seen that the game and toy apparatus in its first or preferred embodiment generally comprises play base 10, vibration base 20 and frame 30. The upper surface of the play base defines play surface 40, over which play pieces (denoted generally as 50) move in response to vibration of the play base. It is noted that the play surface may be flat and unfeatured, or alternatively may include topological or structural features such as hills, bridges or buildings over, under, across and through which the play pieces may travel. If desired, the play surface structural features and play pieces may be thematically related; for example, a farm scene could be used having representations of barns, stables, silos, etc. on the play surface, with play pieces in the form of chickens, cows and the like.

The frame supports the play base and vibration base as well as housing the batteries and electronics controlling operation of the vibratory means. The frame may be provided with a plurality of legs 55 extending downwardly therefrom, the bottom surfaces of the legs engaging a table, floor or other surface. A flat base or bottom rim may be substituted for the legs.

FIG. 2 depicts a top view of the first embodiment of the invention with the play base removed to reveal the isolator members (denoted generally as 60) mounting the vibration base to the frame. The isolator members function to dynamically isolate the frame from the vibration base, thereby minimizing the noise and creeping problems associated with vibration of the frame. The isolator members individually comprise a generally planar band of natural rubber or elastomeric material having apertures formed proximal to the ends thereof, the apertures being in cooperative arrangement (see FIG. 5) with upwardly projecting pins 70 oppositionally arranged on the top surfaces of the frame and vibration base. The pins extend through the apertures disposed in the ends of the isolator members, thereby anchoring the isolator member, which extends in a stretched or tensioned condition between the frame and vibration base. Notice should be taken of the fact that the isolator members suspend the vibration base within the frame and that no portions of the vibration base/play base assembly and frame are in direct contact.

The optimal construction, number and positioning of the isolator members is a function of the geometry, weight and weight distribution of the play base, as well as the weight and location of the vibratory means. For example, if the play surface includes a structure or structures positioned close to the edge of the base, it might be necessary to provide additional and/or reinforced isolators at the edge proximal to the structures in order to prevent tilting of the play base resulting from the uneven weight distribution.

Figure 4:
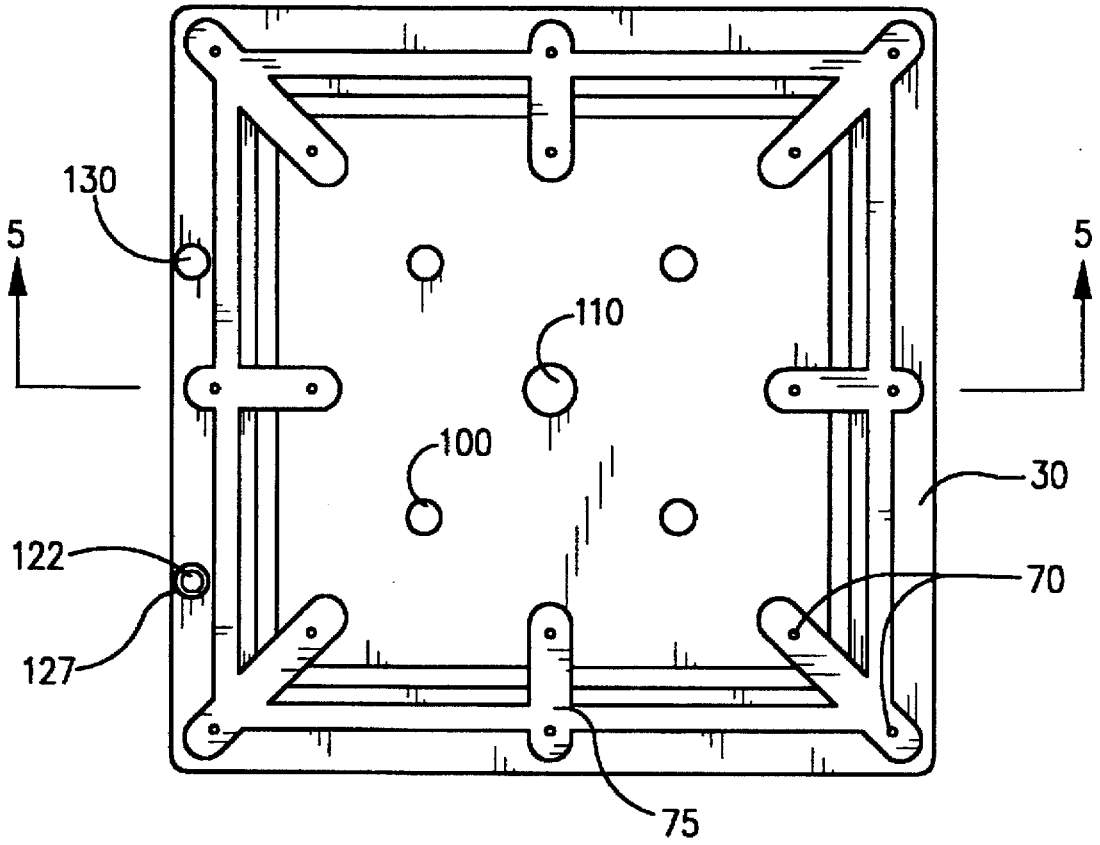
FIG. 4 is a top plan view of the frame/vibration base assembly with the play base removed depicting an alternative construction of the isolator means.

FIG. 4 depicts an alternative construction of the isolator means comprising a continuous strip of natural rubber or elastomeric material extending around the perimeter of the vibration base. The strip includes an array of apertures disposed proximal to the inner and outer edges thereof in cooperative arrangement with the upwardly projecting pins 70 formed on the top surfaces of the frame and vibration base. To accommodate uneven weight distribution on the play base and prevent tilting, segments of the strip proximal to the structures may be thickened.

It is further noted that while preferred embodiments of the isolator means have been shown comprising one or more pieces of elastic material, other types of components may be utilized to effect the dynamic isolation of the frame from the vibration base. For example, metal or plastic springs may be substituted for the elastic members, the ends of the springs being attached to pins or anchors disposed oppositionally on the frame and vibration base.

Figure 5:
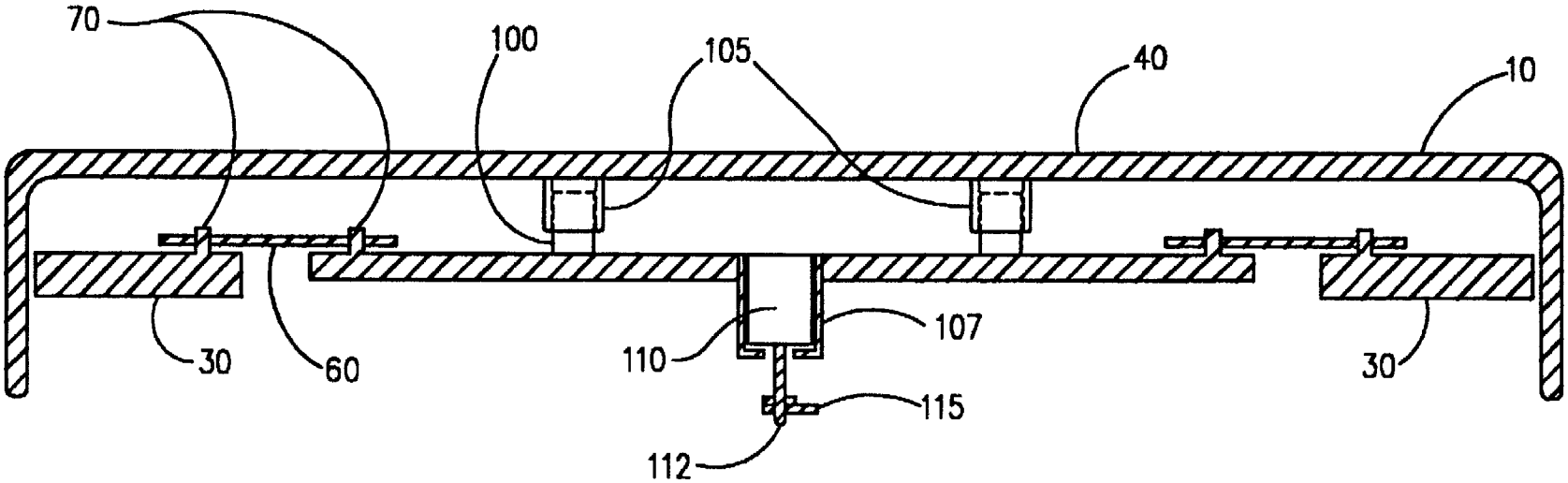
FIG. 5 is a cross-sectional view of the frame/vibration base assembly taken along line 5—5 of FIG. 2.

Referring to FIGS. 1 and 5, the vibration base is provided with a plurality of upwardly extending posts 100 which cooperatively engage receptacles 105 formed in the underside of the play base to secure the play base to the vibration base. It is noted that the post/receptacle fit should be sufficiently snug so as to permit the transmission of vibrations from the vibration base to the play base. The vibration base further comprises a rigid housing 107 for mounting the vibratory means therein.

Figure 3:
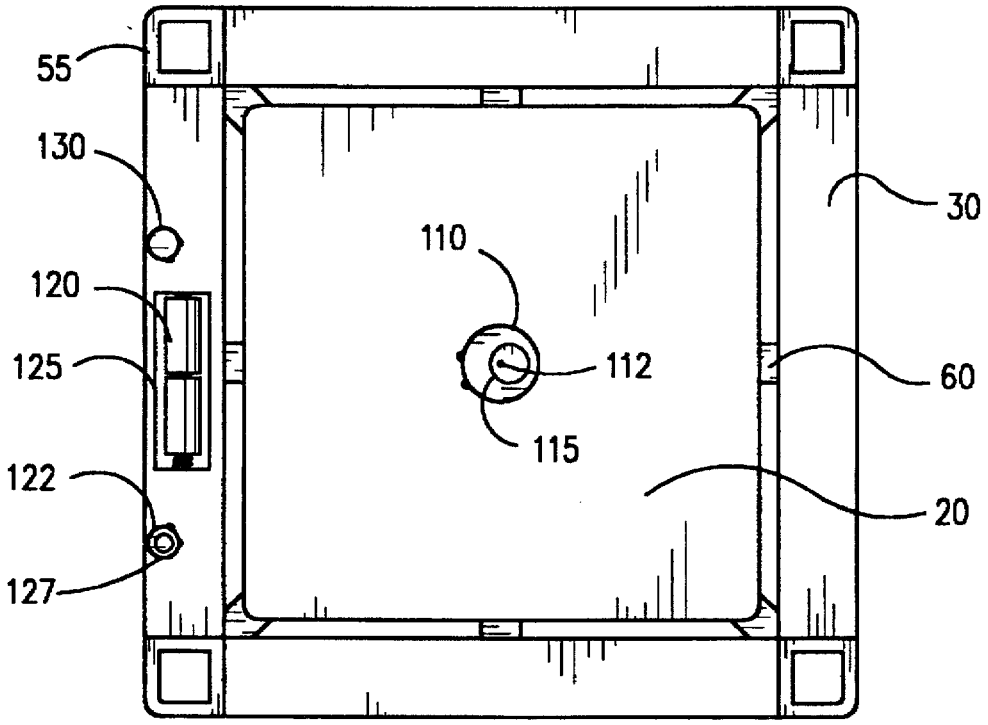
FIG. 3 is a bottom plan view of the frame/vibration base assembly.

Referring now to FIGS. 3 and 5, it is seen that the vibratory means comprises a small electric motor 110 having a drive shaft 112 with generally disk shaped weight 115 mounted eccentrically on the shaft. Electrical current is supplied to the motor by batteries 120 carried in battery housing 125 mounted on or formed within the frame. An on/off switch 122 mounted in switch boss 127 extending upwardly through the play base effects actuation of the motor. The apparatus may additionally be provided with potentiometer 130 connected in series with the motor to permit modulation of the rate of vibration transmitted to the play surface. The apparatus may include other electronic components in association with the motor to vary or optimize the operation thereof. For example, an electronic timer may be incorporated into the motor circuit to shut off the motor after a predetermined time following its actuation, thereby prolonging battery life. Electronic means may also be employed to effect an intermittent on/off operation of the motor, such intermittent operation having been observed to facilitate the movement of play pieces.

Figure 6:
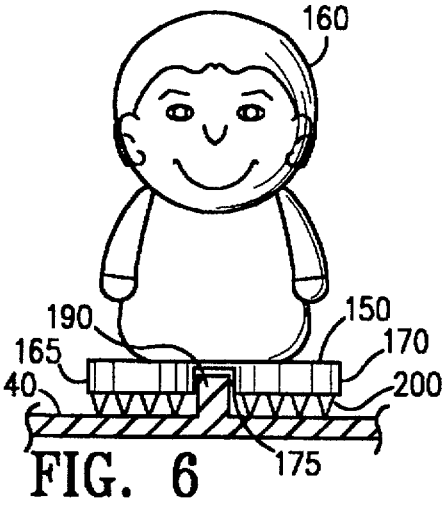
FIG. 6 is a front elevational view of the first construction of the play piece.
Figure 7:
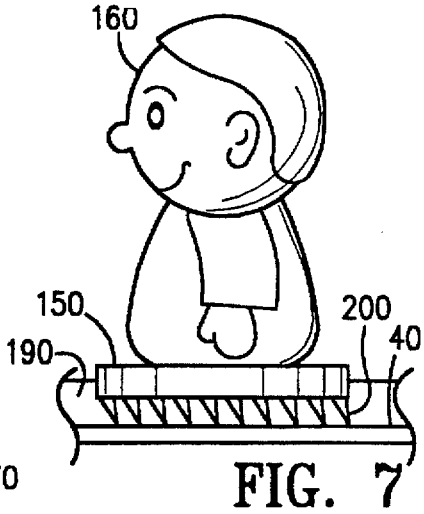
FIG. 7 is a side elevational view of the first construction of the play piece.
Figure 8:
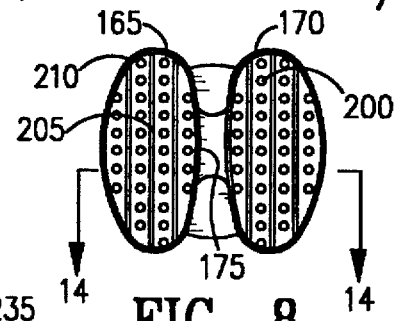
FIG. 8 is a bottom plan view of the fast construction of the play piece.

As is shown in FIGS. 6–8, the play pieces individually comprise a generally planar base 150 supporting body 160 directed generally normally thereto. It is noted that while the play piece herein depicted is a representation of a small boy, play pieces may take a variety of forms, including people, animals and vehicles. It is seen that the play piece base comprises first and second platform members 165 and 170, the platform members having a generally elliptical shape with the long axes oriented parallel to the direction of travel. It is noted that the inner edges of the platform members are in closest proximity to one another at a location generally medial to the front and rear portions of the platform members and diverge forward and rearward therefrom. The medial portion of the inner edges defines groove 175 which may be engaged with guide rail 190 to control the directional movement of the play piece, the guide rail having a rectangular cross-section in cooperative arrangement with the play piece groove. As is shown in FIG. 1, the guide rail may describe a circuit on the play surface along and around which the play piece travels. It is noted that the divergent geometry of the platform member inner edges prevents binding of the play piece and permits it to negotiate turns described by the guide rail.

Figure 12:
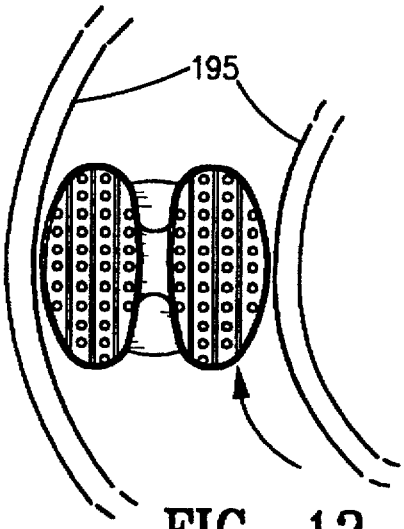
FIG. 12 is a bottom plan view of the play piece depicting the play piece contained within a dual guide rail system.
Figure 13:
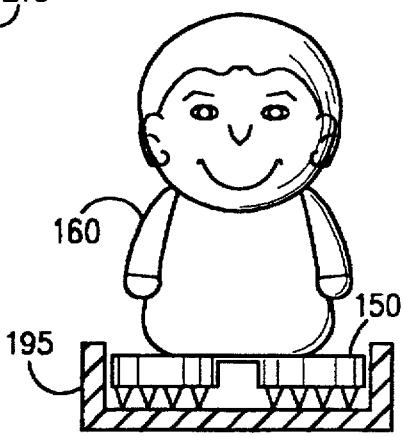
FIG. 13 is a from elevational view of the play piece depicting the play piece contained within the dual guide rail system.

Referring to FIGS. 12 and 13, the directional movement of the play piece may also be controlled by a double guide rail system comprising two parallel guide rails 195 having an orthogonal spacing slightly greater than the width of the play piece base. When placed between the guide rails, the play piece is confined to movement along the track thereby defined. Alternatively, a track recessed into the play surface may be utilized for the same purpose. Notice is taken that a game or toy embodying the present invention may employ one or any combination of the guide systems herein disclosed.

Making reference again to FIG. 8, the play piece driver means comprise a plurality of flexible driver members (denoted generally as 200) depending downwardly and rearwardly from the bottom surfaces of the first and second platform members, the bottom ends of the driver members engaging the play surface. As seen in cross-section in FIG. 14, the upper ends of the driver members may be molded into the platform members or may be attached thereto by adhesive-based or equivalent joining means. The driver members are canted rearwardly so that when the play surface is caused to vibrate by the actuation of the vibratory motor, the play pieces will move preferentially in forwrd direction. It has been observed that the preferred inclination of the driver members is approximately 13°–17° from the vertical; however, the optimal inclination will be function of a number of operational factors, including the topology of the play surface, the size and weight of the play pieces, and the amplitude and frequency of the vibrations.

Figure 14:
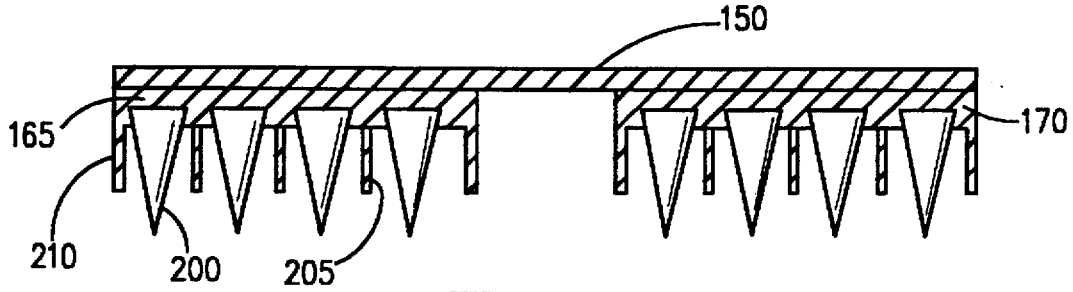
FIG. 14 is a cross-sectional view of the play piece base taken along line 14—14 of FIG. 8 depicting in particular the arrangement of driver members, dividers and skirt.

It is anticipated that toys or games embodying the present invention may be used by very young children, who may attempt to pull the driver members from the play piece base and thereby adversely affect the mobility of the play pieces or render them inoperative. To remedy this potential problem, two separate safeguard measures have been incorporated into the design of the play pieces. First, as depicted in FIGS. 6 and 7, the driver members have an inverted conical or frustro-conical shape which inhibits manual grasping thereof. Second, as is shown in FIGS. 8 and 14, the foot members are provided with a plurality of spacers 205 extending between parallel columns of driver members, and peripheral skirt 210 extending around the periphery of the platform member. The spacers and skirt extend downwardly from the bottom surface of the platform members along a portion of the length of the driver members, thereby preventing digital access to the upper ends of the driver members and making the grasping and removal thereof substantially more difficult.

Figure 9:
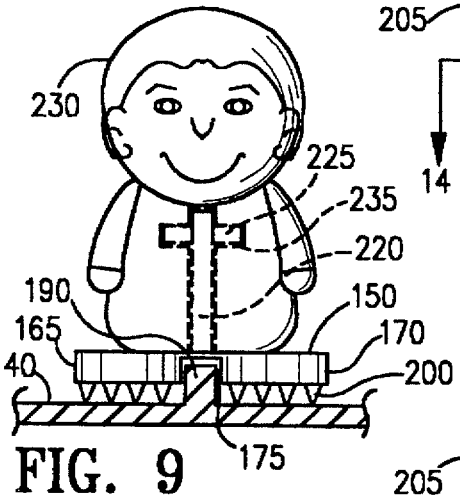
FIG. 9 is a front elevational view of the second construction of the play piece in which the play piece body may exhibit a rocking or wobbling motion.
Figure 10:
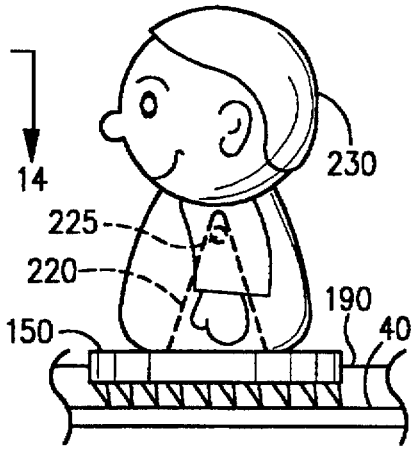
FIG. 10 is a side elevational view of the second construction of the play piece.
Figure 11:
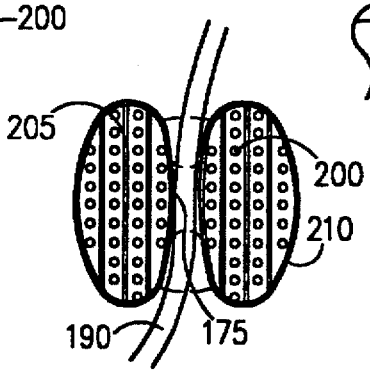
FIG. 11 is a bottom plan view of the play piece depicting the play piece base engaging a single guide rail.

FIGS. 9 and 10 depict an alternative embodiment of the play piece in accordance therewith the play piece may exhibit a rocking or wobbling motion in addition to the translational movement of the piece along the play surface. Mounting post 220 extends upwardly from the play piece base and includes at its distal end hinge pin 225. Play piece body 230 is pivotally mounted on the hinge pin employing cooperatively arranged hinge aperture 235 disposed in the medial inner portion of the body. The hinge pin and apertures may be directed normally to the direction of travel thereby effecting a side-to-side wobbling motion, or may be directed parallel to the direction of travel thereby effecting a forward-and-back rocking motion.

Figure 15:
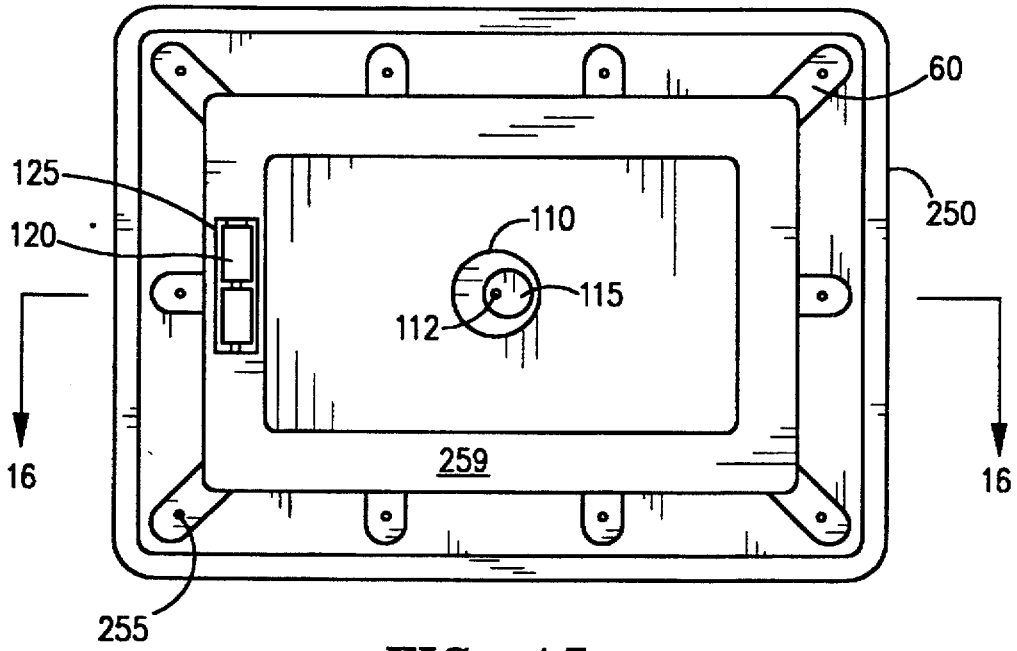
FIG. 15 is a bottom plan view of a second embodiment of the invention in which the vibration base is omitted and the vibratory motor is secured directly to the play base.
Figure 16:
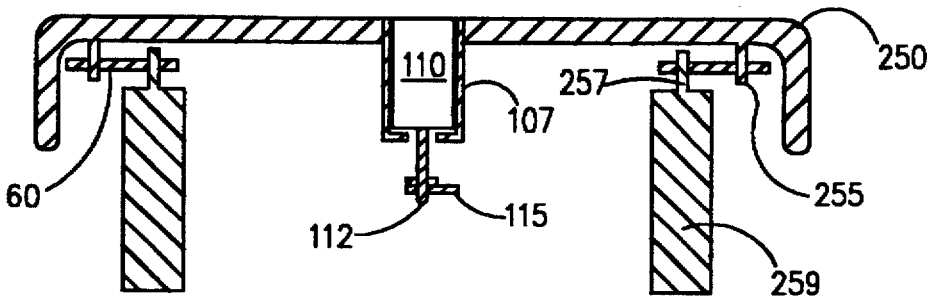
FIG. 16 is a cross-sectional view of the second embodiment of the invention taken along line 16—16 of FIG. 15.

Making reference now to FIGS. 15 and 16, a second embodiment of the invention is depicted in which the play base and vibration base have been integrated into a single unit. It is seen that play base 250 includes a plurality of downwardly projecting pins 255 arranged in opposition to pins 257 disposed on the upper surface of frame 259. The pins engage the corresponding apertures in isolator members 60, thereby mounting the play base to the frame in a manner which dynamically isolates the frame therefrom. The play base further comprises a downwardly directed housing for rigidly mounting the vibrational motor thereto.

A third embodiment of the invention obviates the need for the isolating means. In this embodiment, the entire frame is fabricated from a moldable elastomeric material such as Krayton®. Because the frame is constructed of an elastic material, the need for isolator members is removed and the play base may be directly supported on the frame.

While preferred and alternative embodiments of the invention have been shown and described, it will be apparent to those skilled in the art that various modifications may be made in these embodiments without departing from the spirit of the present invention. For that reason, the scope of the invention is set forth in the following claims.

What is claimed is:

1. A vibratory amusement device comprising:

(a) a play base maintained in a substantially horizontal orientation, said play base having an upper surface for supporting thereon at least one play piece;

(b) a vibration base underlying said play base and being rigidly secured thereto, said vibration base being bound by an outer periphery;

(c) a frame including means for holding said play base and said vibration base above a supporting surface;

(d) isolator means flexibly mounting said vibration base to said frame and holding said vibration base and said frame in spaced apart relation defining a gap therebetween, said isolator means permitting said vibration base to move in two mutually perpendicular horizontal axes relative to said frame;

(e) vibratory means attached to said vibration base, said vibratory means when actuated imparting to said vibration base oscillatory motion in two mutually perpendicular horizontal axes; and (f) at least one play piece disposed on said upper surface of said play base, said play piece including driver means causing said play piece to move on said upper surface of said play base in response to the oscillatory motion of said play base;

whereby said isolator means dynamically isolate the oscillatory motion of said vibration base and said play base from said frame while permitting said vibration base and said play base to move in two mutually perpendicular horizontal axes relative to said frame.

2. A vibratory amusement device according to claim 1, wherein said isolator means comprise a plurality of elongated elastic isolator members spaced around the periphery of said vibration base and maintained in a generally horizontal orientation, each of said plurality of elastic isolator members having a first end and a second end, said first end being secured to said vibration base, said second end being secured to said frame, each of said plurality of isolator members having a medial portion spanning said gap between said vibration base and said frame.

3. A vibratory amusement device according to claim 1, wherein said isolator means comprises a continuous substantially flat elastic strip having an inner edge and an outer edge, said elastic strip being maintained in a generally horizontal orientation, said elastic strip extending between said vibration base and said frame, said elastic strip being attached at a first plurality of locations proximal to said inner edge to said vibration base, said elastic strip being attached at a second plurality of locations proximal to said outer edge to said frame.

4. A vibratory amusement device according to claim 1, wherein said vibratory means comprises at least one electric motor having a downwardly directed shaft and a weight eccentrically mounted on said shaft, said vibratory means additionally comprising means for selectively applying electrical current to said electric motor.

5. A vibratory amusement device according to claim 4 further comprising a potentiometer in operative association with said electric motor, wherein adjusting said potentiometer permits the user to control the frequency of oscillatory motion of said play base.

6. A vibratory amusement device according to claim 4, further comprising timer means in operative association with said electric motor, wherein said timer means interrupt the electrical current flow to said electric motor after a predetermined time following actuation of said electric motor.

7. A vibratory amusement device according to claim 1, wherein said play piece comprises:

a generally planar play piece base having a transverse width and an upper and a lower surface; and an upwardly extending body oriented substantially normally to said play piece base, said driver means comprising a plurality of flexible driver members depending downwardly and rearwardly from said lower surface of said play piece base, said driver members each having an upper end affixed to said play piece base and a lower end engaging said upper surface of said play base.

8. A vibratory amusement device according to claim 7, wherein said driver members have a conical shape.

9. A vibratory amusement device according to claim 7, wherein said driver members have a frustro-conical shape.

10. A vibratory amusement device according to claim 7, wherein said play piece body is pivotally attached to a post extending upwardly from and oriented substantially normally to said play piece base thereby causing said play piece body to exhibit a rocking motion responsive to the oscillatory motion of said play base.

11. A vibratory amusement device according to claim 7 further comprising at least one upstanding guide rail formed on said upper surface of said play base, said guide rail being generally rectangular in cross section and engaging a cooperatively shaped channel formed in said play piece base.

12. A vibratory amusement device according to claim 7 further comprising at least one track formed on said upper surface of said play base, said track being defined by two upstanding rails in mutually parallel relation having an orthogonal spacing slightly greater than the transverse width of said play piece base.

13. A vibratory amusement device comprising:

(a) a play base maintained in a substantially horizontal orientation and being bounded by an outer periphery, said play base having an upper surface for supporting thereon at least one play piece;

(b) a frame including means for holding said play base above a supporting surface;

(c) isolator means flexibly mounting said play base to said frame and holding said play base and said frame in spaced apart relation defining a gap therebetween, said isolator means permitting said play base to move in two mutually perpendicular horizontal axes relative to said frame;

(d) vibratory means attached to said play base, said vibratory means when actuated imparting to said play base oscillatory motion in two mutually perpendicular horizontal axes, and;

(e) said play piece including driver means causing said play piece to move on said upper surface of said play base in response to the oscillatory motion thereof;

whereby said isolator means allow said play base to oscillate in two mutually perpendicular horizontal axes while preventing said oscillatory motion from being transmitted to said frame.

14. A vibratory amusement device according to claim 13, wherein said isolator means comprise a plurality of elongated elastic isolator members radially spaced around the periphery of said play base and maintained in a generally horizontal orientation, each of said plurality of elastic isolator members having a first end and a second end, said first end being secured to said play base, said second end being secured to said frame, each of said plurality of isolator members having a medial portion spanning said gap between said play base and said frame.

15. A vibratory amusement device according to claim 13, wherein said isolator means comprises a continuous substantially flat elastic strip having an inner edge and an outer edge, said elastic strip being maintained in a generally horizontal orientation, said elastic strip extending between said play base and said frame, said elastic strip being attached at a first plurality of locations proximal to said inner edge to said play base, said elastic strip being attached at a second plurality of locations proximal to said outer edge to said frame.

16. A vibratory amusement device according to claim 13, wherein said vibratory means comprises at least one electric motor having a downwardly directed shaft and a weight eccentrically mounted on said shaft, said vibratory means additionally comprising means for selectively applying electrical current to said electric motor.

17. A vibratory amusement device according to claim 16 further comprising a potentiometer in operative association with said electric motor, wherein adjusting said potentiometer permits the user to control the frequency of oscillatory motion of said play base.

18. A vibratory amusement device according to claim 16, further comprising timer means in operative association with said electric motor, wherein said timer means interrupt the electrical current flow to said electric motor after a predetermined time following actuation of said electric motor.

19. A vibratory amusement device according to claim 13, wherein said play piece comprises:

a generally planar play piece base having a transverse width and an upper and a lower surface; and an upwardly extending body oriented substantially normally to said play piece base; said driver means comprising a plurality of flexible driver members depending downwardly and rearwardly from said lower surface of said play piece base, said driver members each having an upper end affixed to said play piece base and a lower end engaging said upper surface of said play base.

20. A vibratory amusement device according to claim 19, wherein said driver members have a conical shape.

21. A vibratory amusement device according to claim 19, wherein said driver members have a frustro-conical shape.

22. A vibratory amusement device according to claim 19, wherein said play piece body is pivotally attached to a post extending upwardly from and oriented substantially normally to said play piece base thereby causing said play piece body to exhibit a rocking motion responsive to the oscillatory motion of said play base.

23. A vibratory amusement device according to claim 19 further comprising at least at least one upstanding guide rail formed on said upper surface of said play base, said guide rail being generally rectangular in cross section and engaging a cooperatively shaped channel formed in said play piece base.

24. A vibratory amusement device according to claim 19 further comprising at least one track formed on said upper surface of said play base, said track being defined by two upwardly extending rails in parallel relation having an orthogonal spacing slightly greater than the width of said play piece base.

25. A play piece adapted for use with a vibratory amusement device, said vibratory amusement device having a surface for supporting thereon said play piece, said play piece comprising:

(a) a horizontally oriented base member and a body member extending upwardly therefrom;

(b) said base member comprising a first and a second platform member, said first and second platform members being generally elliptical in shape and being in spaced apart relation wherein said first and second platform members define therebetween a channel, said channel having a narrow medial portion for engaging a cooperatively shaped guide rail formed on said surface of said vibratory amusement device, said channel widening forwardly and rearwardly of said medial portion, said first and second platform members each having a lower surface;

(c) a plurality of flexible driver members depending rearwardly and downwardly from said first and second platform member lower surfaces, said driver members each having a lower end for engaging said upper surface of said vibratory amusement device;

whereby said play piece is caused to move forwardly along said guide rail in response to the oscillatory motion of said upper surface of said vibratory amusement device, and said channel is shaped to permit said play piece to negotiate curved portions of said guide rail without binding.

26. A play piece according to claim 25, wherein said body member is pivotally mounted on a post projecting upwardly from said base member thereby permitting said body member to exhibit a rocking motion responsive to the motion of said surface.

* * * * *